United States Patent [19]

Brunn

[11] Patent Number: 4,898,421

[45] Date of Patent: Feb. 6, 1990

[54] FOLDING FURNITURE

[76] Inventor: Oswald Brunn, Bunzlauer Platz 1, Munich, Fed. Rep. of Germany

[21] Appl. No.: 18,094

[22] Filed: Feb. 20, 1987

[30] Foreign Application Priority Data

Mar. 7, 1986 [DE] Fed. Rep. of Germany ..... 3607619
Mar. 7, 1986 [DE] Fed. Rep. of Germany ..... 3607581

[51] Int. Cl.[4] ..... A47C 4/00

[52] U.S. Cl. ..... 297/28; 297/35; 297/359

[58] Field of Search ..... 297/28, 27, 359, 360, 297/16, 35, 39

[56] References Cited

U.S. PATENT DOCUMENTS

| | | | |
|---|---|---|---|
| 887,267 | 5/1908 | Petry | 297/359 |
| 2,072,075 | 2/1937 | Travers et al. | 297/28 |
| 2,243,502 | 5/1941 | Freedman | 297/28 |
| 2,638,970 | 5/1953 | Harber | 297/359 X |
| 3,075,811 | 1/1963 | Brown | 297/359 |
| 3,186,757 | 6/1965 | Hopkins | 297/28 |

FOREIGN PATENT DOCUMENTS

| | | | |
|---|---|---|---|
| 169112 | 10/1951 | Austria | 297/28 |
| 582432 | of 0000 | Italy | 297/28 |
| 439465 | 12/1935 | United Kingdom | 297/28 |

*Primary Examiner*—Francis K. Zugel
*Attorney, Agent, or Firm*—Townsend and Townsend

[57] ABSTRACT

A furniture with a guide groove in each back leg for the purpose of folding up the furniture is provided with catch elements in the region of the guide groove. This makes it possible to adjust the seat at various inclinations with respect to the horizontal plane. According to a first embodiment a plurality of catch recesses are provided on one end of each guide groove. According to a second embodiment catch grooves are provided at one end of the guide groove which are substantially parallel to one another and extend at an obtuse angle from the guide groove. An adjustment means for a folding furniture comprises catch means provided in the region of one of the arm rests and protruding downwardly. The adjustment means operates together with an element which projects laterally in the region of a connection section between a front and back leg of the piece of folding furniture. According to a preferred embodiment of the invention, the catch means is provided in the form of a plate which contains catch recesses extending from a guide slot such that the element provided in the form of a journal can be engaged in various catch recesses.

16 Claims, 7 Drawing Sheets

FOLDING FURNITURE

This invention concerns a folding furniture, more particularly a folding armchair, and adjustment means for a folding furniture.

Known folding furniture can be adjusted to two positions, namely an open or seating position, in which the seat and back form between them an angle of more than 90°, and a folded position in which the rear and the seat are substantially parallel to each other, thereby making it possible to store the furniture in a space-saving manner.

There are also folding furniture which comprise adjustment means in the region of the arm rest whereby the inclination of the chair back can be adjusted. In the case of such adjustment means (see German patent 3,309,186) the catches are provided on the bottom side of the arm rest and operate together with a catch cam which is provided on the upper side of a connecting section facing the arm rest between each pair of front and back legs. The catches formed on the bottom side of the arm rest have the disadvantage that when the folding furniture is folded the arm rest comes to rest approximately parallel to the two back legs, spaced a distance therefrom as a result of the catches causing the arm rest to lie against the back legs. The space corresponds to the depth of the catches and as a result the folding furniture takes up a relatively large amount of storage space when folded. In addition, the catch cam is subject to considerable wear if the adjustment means is operated often, and it may easily break if too much force is used. The awkwardness of the folding furniture pieces when folded is increased due to the fact that each pair of front and back legs is connected by means of complex joint means and the front and back legs cannot rest directly on each other when the folding chairs are folded.

Both types of folding furniture have the drawback that the inclination of the seat or the seat surface cannot be adjusted when the furniture is in use.

SUMMARY OF THE INVENTION

It is therefore the object of the invention to provide a folding furniture piece of the type described above, in the case of which the inclination of the seat can be adjusted in a simple manner.

Further embodiments of the folding furniture pieces are apparent from the subordinate claims.

The invention provides a folding furniture in which the guide, which is provided perferably on the inner side of the back legs, for guide elements, which project outwardly from the side of the back, is provided with catch grooves located at different heights along the back leg, whereby the guide elements can be engaged at various heights of the back leg. In this way, it is possible to variously adjust the inclination of the seat.

The catch grooves may be embodied either as extensions deflected at an acute angle with respect to the guide or as circular-shaped recesses or bores inside the guide. In the latter case, the guide elements are adjustably mounted in the lateral direction with respect to the chair.

The invention provides a folding furniture which enables the inclination of the seat to be adjusted in a simple manner. In this way, the furniture can be designed not only as a deck-chair or hammock-chair but also as a normal chair with a horizontal seat, such as a dining chair or the like.

The invention also provides adjustment means which is preferably used for folding furniture, in particular for folding chairs made of wood. It may also be used for folding chairs made of another material such as plastic and/or metal. By providing the catch means on a part of the arm rest which extends downwards and is substantially vertical, the folding furniture piece can be folded relatively flat. When folded, the front and back legs come to lie in a position where they are parallel to each other and rest adjacent each other. Also, the back leg comes directly into contact with the lower surface of the arm rest. In this way it is ensured that the chair is simple to transport and it can be stored so as to take up the smallest possible amount of space.

A further advantage of the adjustment means is that it is extremely simple to mount and that it is practically wear-free in operation. At the same time it does not limit in any way whatsoever the range within which the arm rest can be inclined.

According to a preferred embodiment example of the invention the arm rest has two parts protruding downwardly from it and extending substantially vertically and adding a recess which is open to the rear. The recess holds at least part of the back and front leg when the chair is folded.

BRIEF DESCRIPTION OF THE DRAWINGS

In the following, preferred embodiment examples of the folding furniture will be described in greater detail with reference to the drawing, in which.

DETAILED DESCRIPTION OF THE PREFERRED EMBODIMENTS

Figure 1:
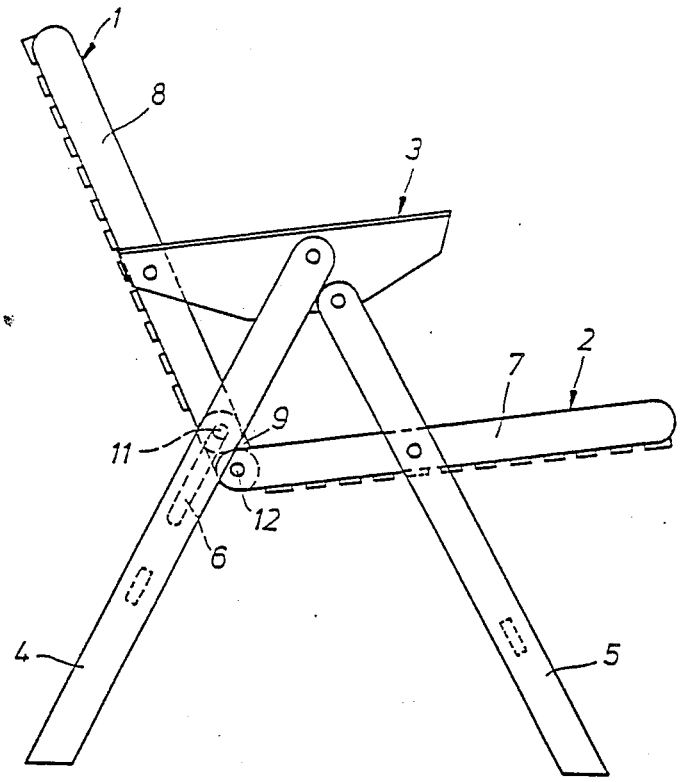
FIG. 1 is a lateral view of a folding furniture for explaining the fundamental features of the guide.

FIG. 1 shows a lateral view of a folding furniture comprising a back 1, a seat 2, arm rests 3, back legs 4 and front legs 5. Guides 6 are provided along the back legs 4 on the surface facing towards the inside. These are indicated by a broken line in FIG. 1. If the furniture is made of wood the guides are in the form of a groove which is milled on the inner surface of the back legs 4. Again, if the furniture is made of wood the seat 2 comprises side-beams 7 and the back 1 has side-beams 8. In the embodiment example shown, the side-beams 8 are connected to the side-beams 7 by means of connection pieces 9. The connection pieces 9 are rotatably mounted on the side-beams 8 by means of pins, bolts or the like. These pins or bolts are indicated by 11. Similarly, the connection pieces 9 are rotatably mounted on the side-beams 7 by means of pins and bolts. Furthermore, the arm 3 is generally rotatably linked to the side-beam 8 and is rotatably mounted on the upper ends of the front and back legs 4, 5. Each front leg 5 is rotatably attached to the corresponding side-beam 7. As is apparent from FIG. 1, the guide elements 11, which may, by way of example, be in the form of pins, engage the guide 6 which is formed by a guide groove on the back leg 4. The guide elements 11 may also be provided somewhere else on the chair, for instance at the position of the pins or bolts 12 or in the region of the connection piece 9.

Figure 2:
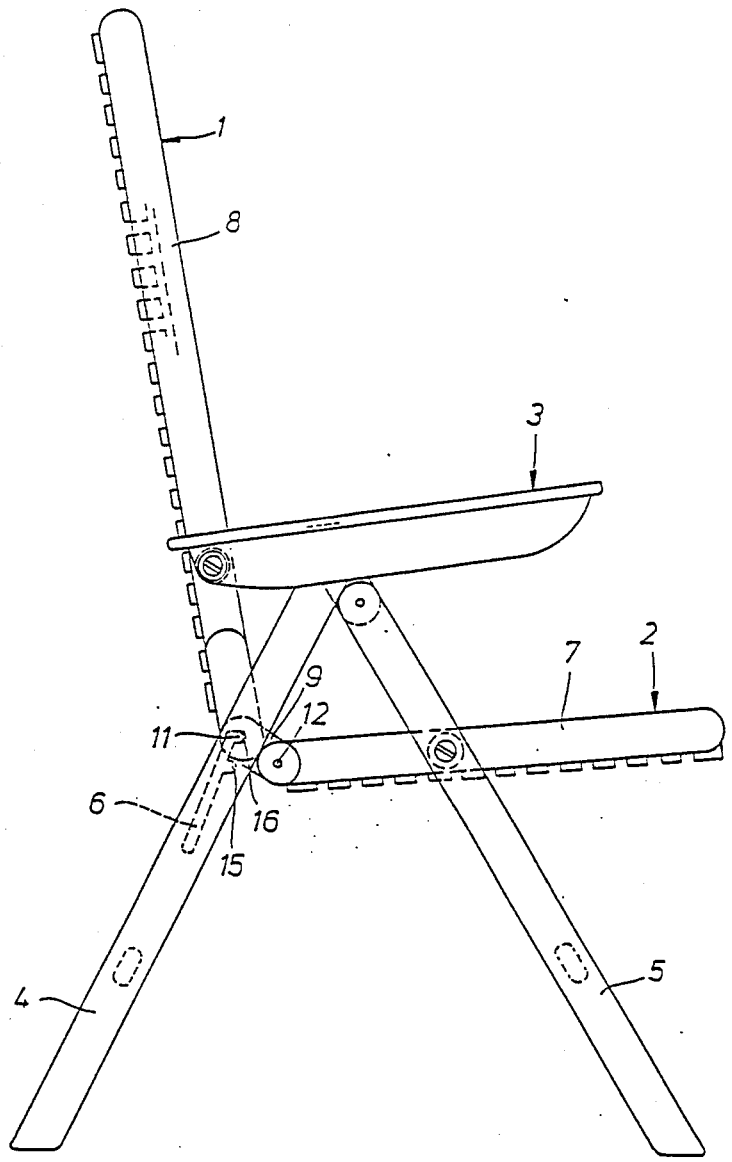
FIG. 2 is a lateral view of a piece of folding furniture for explaining an embodiment example of the guide.

The guide 6 described with reference to FIG. 1 has the shape of a groove in the embodiment example shown in FIG. 2. It is milled or otherwise shaped in the inward surface of the back leg and extends for a predetermined lengh of the back leg. Two catch grooves 15, 16 are provided at the upper end of this guide groove 6. They have substantially the same shape and depth as the guide groove 6 opening directly thereinto. The catch grooves 15, 16 extend substantially parallel to each other and are spaced apart such that the inclination of the seat 2 can be noticeably adjusted. A larger number of such catch grooves can be provided instead of the two catch grooves 15, 16. They each open into the guide groove 6 so that the guide elements 11 can snap out of the guide groove 6 and into the desired pair of catch grooves, e.g. 15 or 16, when the chair is adjusted. In the embodiment shown in FIG. 2, the catch grooves 15 or 16 are provided at an obtuse angle to the guide groove 6. This alignment of the catch grooves with respect to the guide groove 6 has the advantage that the guide elements 11 do not slip back into the guide groove 6 as soon as a slight pressure is applied to the front edge of the seat 2, what could result in unintentional adjustment of the chair. However, it may also be adequate to have the catch grooves 15, 16 etc. project horizontally from the guide groove 6. Furthermore, it may also be an advantage to have the guide groove 6 slightly inclined with respect to the axis of the back legs, as is illustrated in FIG. 2.

The guide with catch grooves explained with reference to FIG. 2 can be used in a folding furniture the back 1 of which is adjustable, in which case the adjustment mechanism is integrated in the arm 3 shown in FIG. 2. It may also be used in a folding furniture, the back 1 of which is not adjustable, as shown in FIG. 1.

Figure 3:
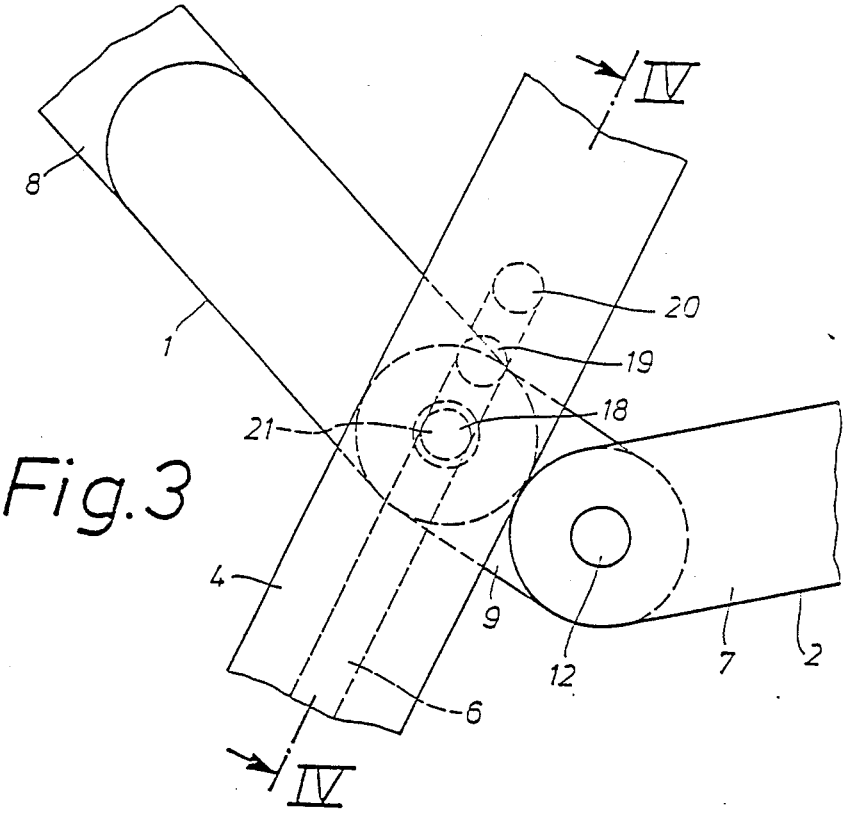
FIG. 3 is a partial view of the guide for the purpose of explaining a varied embodiment example.

FIG. 3 shows a further embodiment of the invention with respect to the adjustment mechanism for regulating the inclination of the seat. Here, too, the guide 6 is preferably formed by a guide groove extending along the inward surface of the back leg 4. In contrast to the embodiment example shown in FIG. 2 it contains recesses or bores along the guide groove which are indicated by the numbers 18, 19 and 20. In order to obtain a height adjustment this embodiment must be provided with laterally adjustable pins 21, which are preferably in the form of threaded screws which can be screwed laterally in and out of a screw socket 22. The socket 22, which has an internal thread corresponding to that of the threaded pin 21, is set in the side-beam 8, it passes through the respective connection pieces 9 and preferably passes through a spacing element or distance washer 24 which is generally arranged between the back or the seat and the legs of folding chairs. For the purpose of moving the threaded pin 21, the latter is provided at the end facing the inner side of the chair with a ball 25 or other operating element. By means of the latter it can be screwed in the screw socket 22 fixedly arranged in the side-beam 8 into the guide groove 6 or out of the guide groove 6.

Figure 4:
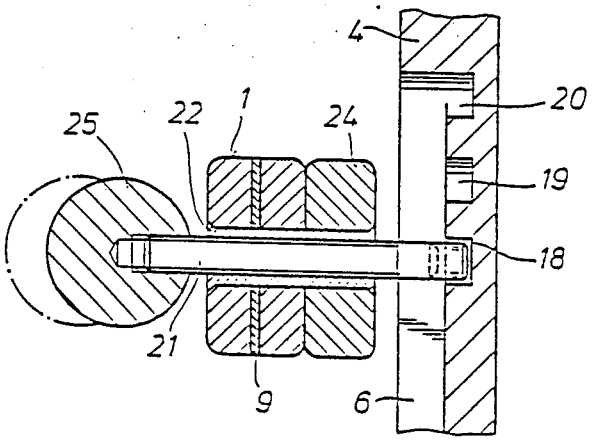
FIG. 4 is a partial sectional view of the guide as shown in FIG. 3 for the purpose of explaining the corresponding adjustment mechanism.

FIG. 4 shows three recesses 18 to 20 arranged above one another along the guide groove 6. This means that in this embodiment the seat can be adjusted to have three different inclinations. The recesses 18 to 20 preferably have a circular-shaped profile which is adapted to the external diameter of the pin 21. In order to adjust the inclination of the seat 1 in this embodiment example the pin 21 is turned left a certain amount in FIG. 4 until it is just shifted out of the respective recess, e.g. 18, whilst nevertheless remaining within the guide groove 6. After adjusting the inclination of the seat it can be screwed back into the other respective corresponding recess.

As is apparent from FIG. 3 the guide groove is provided substantially in the middle of the inner surface of the back leg 4 running along the latter, i.e. at the height of the axis of the back leg 4.

It should also be mentioned that the pin 21 may also be provided in the region of the connection piece 9 when the embodiment described above is accordingly varied. If the connection piece 9 is thick enough, an internal thread corresponding to the pin 21 is provided directly in the connection piece 9, which is made preferably of metal, and it is then no longer necessary to insert a screw socket 22 as described with reference to FIG. 4. Furthermore, the pin 21 and the corresponding screw socket may also be provided in the region of the beam 7, i.e. instead of the pins 12 and hence in the region of the seat 2 with appropriate adaptation of the swivels of the front and back legs with respect to the surface of the seat of the arm rests 3.

In accordance with a further embodiment of the invention a pin or bolt is provided instead of the threaded pin 21. This pin or bolt is preferably urged towards the guide groove 6 by means of the bias force of a spring. For adjusting the inclination of the seat it has to be pulled out towards the centre of the chair against the pretension of the spring. After readjusting the inclination of the seat the pin must be released for the purpose of engaging it in a corresponding catch recess.

It is apparent from the above description that the folding chair is constructed symmetrically with regard to the right front and back leg, on the one hand, and the left front and back leg, on the other hand, and hence with regard to the adjustment mechanism described below.

The described mechanism for adjusting the inclination of the seat is used preferably for folding chairs made of wood. However, it may also be used advantageously for folding chairs made of plastic and/or metal.

Adjustment means for folding furniture will be described in the following which make it possible to fold up the folding chairs in a very compact form, for example for the purpose of storing them away.

Figure 5:
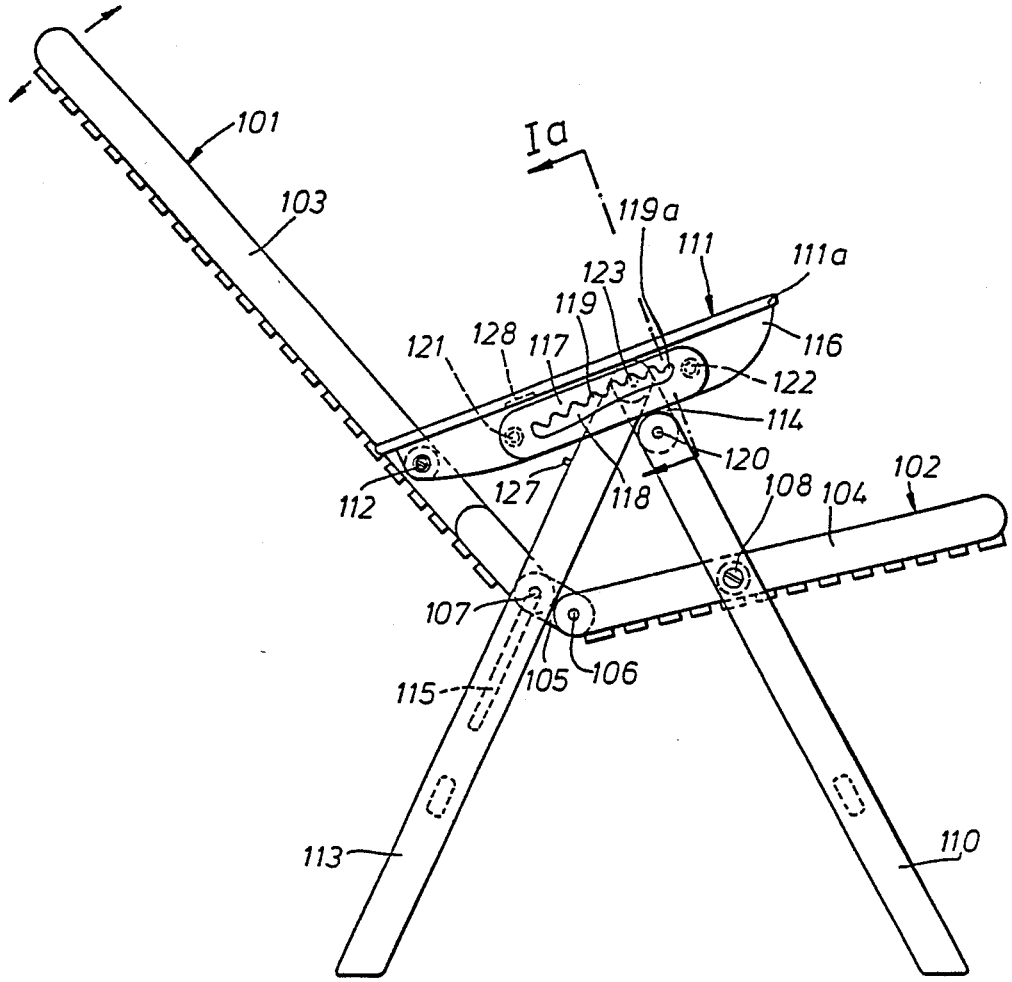
FIG. 5 is a first embodiment example of the folding furniture showing the back of the chair at one of a plurality of inclination positions.

FIG. 5 is a lateral view of a folding chair comprising a back 101 and a seat 102. The back 101 comprises side-beams 103 and the seat has a side-beam 104. The back 101 and the seat 102 are connected at their side-beams 103, 104 by means of a connection piece 105 which is preferably made of metal. The connection piece 105 is mounted to the ends of the side-beams 103, 104 facing each other in the usual manner by means of pins or bolts 106, 107. For this purpose the ends of the two side-beams 103, 104 facing each other have each preferably a slot milled into them which engages the plate-like connection piece 105 and by means of which pins or bolts 106, 107 are rotatably mounted with respect to the side-beams 103, 104. Each side-beam is rotatably connected to a front leg 110 by means of a screw 108. Similarly, an arm 111 is rotatably connected at one end to the corresponding side-beam 103 by means of a screw 112. Each front leg 110 is connected to the corresponding back leg 113 preferably in the same manner as described in the case of the side-beams 103, 104, i.e. by means of a preferably plate-like connection piece 114. In accordance with the illustrated embodiment example, the upper ends of the front leg 110 and back leg 113 are slotted for receiving the connection piece 114. The connection piece 114 is rotatably mounted in the manner described hereinafter with respect to the upper ends of the front leg 110 and the back leg 113 by means of bolts or the like. The bolts 107 project outwardly from the side of the side-beam 103 and engage the guide groove 115 which is provided along the inner surface of the back leg 113 along a given length which allows the chair to be folded. This means that the guide groove 115 is provided in the surface of each back leg 113 facing inwardly. This ensures the relative movement of the connection piece 105 or the lower end of the beams 103 with respect to the back leg 113 when opening and folding the chair with respect to the fixed pivots at 108, 112.

Figure 5A:
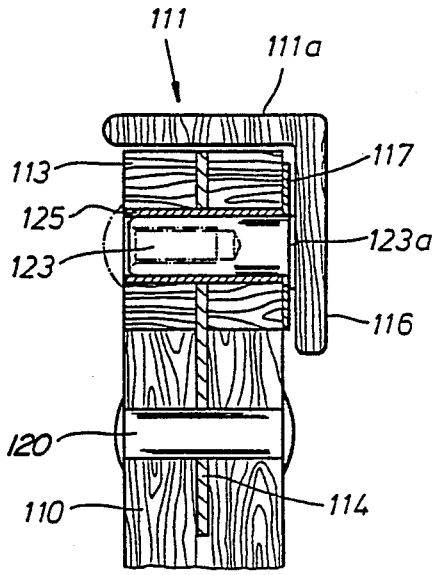
FIG. 5*a* is a sectional view from the front of the right arm of the chair shown in FIG. 5.
Figure 6:
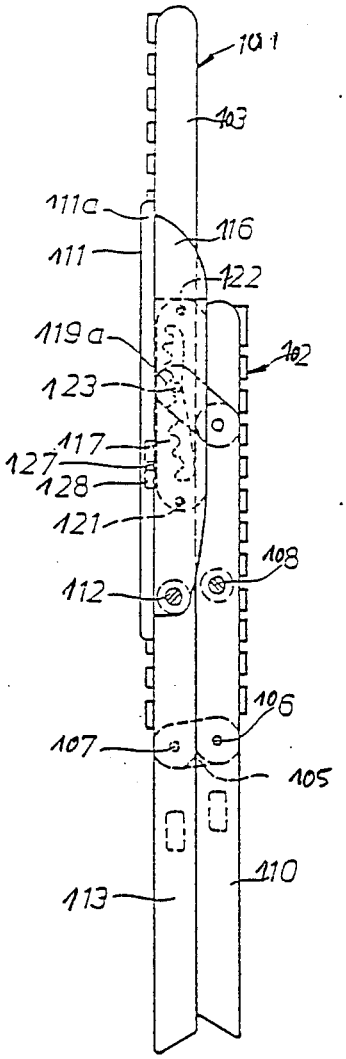
FIG. 6 shows the chair in its folded state.

The arm rest 111 belonging to the adjustment means in the embodiment shown in FIGS. 5 and 6 comprises a support surface 111*a* on which the arm may be laid in known manner. A part 116 projecting downwardly approximately vertically is provided on the support surface 111*a*. The part 116 is preferably fixedly connected at its upper edge with the support surface 111*a*. According to FIG. 5 it serves for mounting the arm 111 on the corresponding side-beam 103 by means of the above-mentioned screw 112 or the like. Although the vertical part 116 may itself be provided in the form of catch means by milling it, it is preferred (FIG. 5) to have the part 116 serve as a mounting element for a plate 117 with catch recesses. This plate 117, which can also be referred to as a catch plate, has a slightly curved guide slot 118, which, however, extends substantially in the direction of the arm 111 or the support surface 111*a*, and catch recesses 119 extending upwardly from the guide slot 118. The plate 117 is mounted from the outside on the substantially angular-shaped arm 111 by means of mounting elements 121, 122. In the embodiment illustrated, which will be explained hereinafter with reference to FIG. 9, these mounting elements are fixedly attached as pins to the plate 117, to the side of the guide slot 118 and they are pressed in for fixing the plate 117 in corresponding openings or bores provided appropriately spaced in the part 116. FIG. 5*a* shows a sectional face view of the right arm of the chair illustrated in FIG. 5.

As is apparent from FIG. 5*a*, the supporting surface 111*a* projects horizontally outwards from the vertical part 116 to the extent that it covers from above the connection region between the front leg 110 and the back leg 113 as well as the upper ends of the front leg 110 and the back leg 113.

A journal 123 is provided for engaging the plate 117. The journal 123 has a top 123*a* (see FIG. 7) at the end facing the part 116. The top 123*a* of the journal 123 is movably arranged between the plate 117 and the part 116 when the adjustment means is mounted as shown in FIGS. 5 and 6. For this purpose, the plate 117 is mounted on the part 116 while maintaining a distance corresponding to the thickness of the top 123*a*, for example by means of spacing elements (not shown) which may be provided in the region of the mounting elements 121, 122 on the surface of the plate 117 facing the part 116. The end of the journal 123 opposite the head or top 123*a* is arranged in the upper end of the back leg 113. In accordance with a preferred embodiment, the upper end of the back leg 113 bears a bearing shell 125 which, on the one hand, serves to fixedly secure the connection piece 114 with respect to the back leg 113 and which, on the other hand, is provided for holding the topless end of the journal 123. The other end of the connection piece 114 is rotatably mounted at the upper end of the front leg 110 by means of a bolt or the like. In order to adjust the inclination of the back 101 the arm 111 is lifted and the journal 123 is shifted along the guide slot 118 and allowed to slip into the catch recess which corresponds the the desired inclination of the back 101.

If the chair is folded from the open, seating position shown in FIG. 5 to the closed, storage position shown in FIG. 6, it may be appropriate in the case of one embodiment of the folding chair to shift the journal 123 to the foremost catch recess, which is indicated by 119*a* in FIG. 5, or to some other predetermined catch recess, in order to achieve an extremely compact storage configuration. For ensuring proper shifting of the journal 123 a stopper element 127 is provided on the back leg 113. This stopper element 127 may be in the form of a pin and it is provided on the edge of the back leg 113 facing to the back at a distance from the pivot defined by the journal 123. This distance corresponds approximately to the length of the guide slot 118. When the chair is folded the stopper element 127 is at rest on the bottom surface of the support surface 111*a*, thereby causing the journal 123 to swivel out of one of the catch recesses 119, whereby the journal 123 enters the guide slot 118 at the same time shifting the stopper 127 into an associated recess 128 which is provided in the lower surface of the arm 111. In this way, the stopper element 127 shifted into the recess 128 when the chair is in its folded state prevents the arm 111 and/or the legs 104, 105 from remaining in a position in which they are not completely parallel. FIG. 6 shows that the stopper element 127, which is in the form of a pin, comes to rest in the recess 128 when the chair is completely folded. THe journal 123 is able to snap into the constructionally predetermined catch recess 119*a*. In the embodiment shown in FIG. 6 the predetermined catch recess 119*a* corresponds to a different catch recess to the one described in conjunction with FIG. 5.

Figure 7:
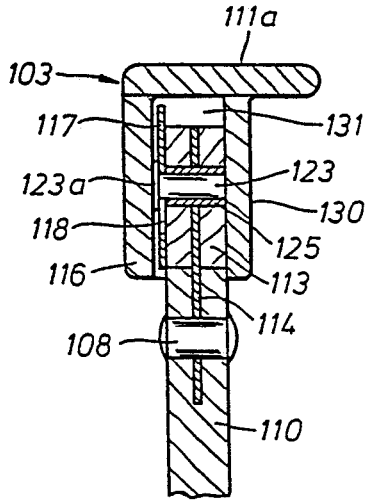
FIG. 7 is an enlarged partial view of the arm of a further embodiment example of the chair.

FIG. 7 shows a varied embodiment of the folding chair compared to the one shown in FIGS. 5 and 6. The arm has two parts 116, 130 which project vertically downwards. The two parts 116, 130 are attached to the supporting surface 111*a*. The difference with respect to the embodiment shown in FIGS. 5 and 6 is that the part 130 is provided in addition to the part 116. As is apparent from the drawing, the parts 116, 130 may also form an integrated element together with the supporting surface 111*a* even if the part 116 in FIGS. 5 and 6 and the parts 116, 130 in FIG. 7 are shown as parts which have to be additionally mounted on the supporting surface 111A. The distance between the parts 130 and 116 is slightly larger than the width of the legs as seen in FIG. 7, in particular the front and back legs. The arrangement of the plate 117, the journal 123 with its top 123*a* is the same as described with reference to FIGS. 5 and 6. Parts shown in FIGS. 5 and 6 and appearing again in FIG. 7 are indicated by the same reference numbers.

As is apparent from the drawing according to FIG. 7, the parts 116, 130 at the same time form a guide for the upper ends of the legs 110, 113. The part 130 provides, in contrast to the embodiment of FIGS. 5 and 6, optical protection and a mechanical protection with respect to the adjustment means. The recess or guide defined by the two parts 116, 130 is indicated by 131 in FIG. 7 and is preferably closed at the front end of the arm rest in FIG. 8, which is illustrated by reference number 132. At the same time the recess 131 on the side facing the back 101 is not closed so as to make it possible to shift the legs 110 and 113 into this recess 131 for the purpose of folding the chair to the position as shown in FIG. 6. As is seen from FIG. 8 the back leg 113 is moved towards an arrow A while folding the chair, whereby the stopper element 127 moves until it rests against the lower surface of the arm 111, as shown by the dotted line. This shifts the journal 123 from the position of engagement in a catch recess 119 into the guide slot 118, causing the journal 123 to move towards the arrow B along the guide slot 118 and into the predetermined catch recess 119 so that the folding chair can then assume the compact form shown in FIG. 6.

The plate 117 is preferably attached to the part 116 by means of journals or pins 121, 122 projecting from both its ends. In the embodiment according to FIG. 5, the plate can also be attached by screws, instead of by pins or journals 121, 122. However, pins or journals 121, 122 are preferably used. and inserted into recesses or bores in the part 116. The bores or recesses 133 have the same or a slightly larger diameter than the corresponding journals 121, 122. This ensures secure, albeit detachable mounting of the plate 117 on the part 116. The bores or recesses in the part 116 associated with the journals 121, 122 are drilled into the part 116 from the outer surface or from the recess 131. As shown in particular in FIGS. 7 and 9, the journal 123 is movably seated with its top 123*a* inside the recess 131 (at the same time being pivoted in the bearing shell 125) such that the top 123*a* can come to rest on the part 116, whereas the free end of the journal 123 remains a slight distance away from the part 130. The journal 123 together with the top 123*a* has a length which is slightly shorter than the width of recess defined the parts 116, 130. In this way the parts 116, 130 can exercise a guide function with respect to the journal 123 when it is shifted together with the upper end of the back leg 113 along the guide slot 118 of the plate 117.

In the embodiment described with reference to FIGS. 5 to 8 the back 101 is preferably guided along a guide or guide groove 115 by means of pins or bolts 107 provided at its lower end, and the pin 107 serves as a connection member with the connection piece 105 so as to connect the back 101 to the seat 102 which, in a similar fashion, has a pin 106 on the rear portion of the seat or side-beams 104. Furthermore, the bearing shell 125 is provided in both embodiments preferably in the upper end of the back leg 113. The bearing shell 125 serves not only for holding the journal 123 but also as a connection member acting together with the connection piece 114 which connects the upper end of each back leg 113 to the upper end of the corresponding front leg 110. The connection piece 114 is rotatably mounted on the front leg 110 with respect thereto by means of a corresponding pin 120.

The space or distance defined between the two parts 116, 130 is therefore slightly larger than the clear widths of the sections of the front or back legs 110 and 113 held in this space. Since the journal 123 has a length corresponding approximately to the space between the two parts 116, 130; the free end of the journal 123 can come to rest on the part 130 in the event of lateral forces occurring. This prevents the top 123*a* of the journal 123 from pulling the plate 117 out of its anchorage when such lateral forces are brought to bear on the plate 117.

Figure 9:
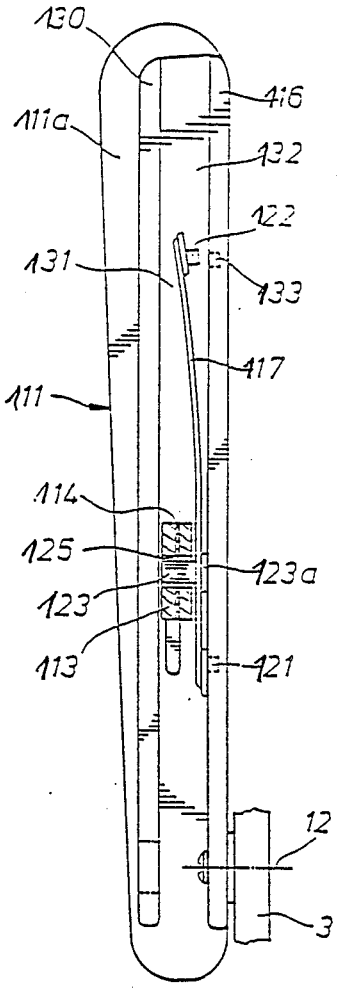
FIG. 9 is a view of the arm of the chair as shown in FIG. 7, shown from below.

For the purpose of mounting the adjustment means the plate 117 is inserted in the corresponding bore or recess in the part 116 by means of the journal 121. Then the journal 123 is inserted in the guide slot 118 such that its top 123*a* comes to rest between the plate 117 and the part 116. At the same time the journal 123 is inserted in the bearing shell 125 which is preferably provided in the upper end of the back leg 113 or in the region of the connection piece 114. During the mounting of the journal 123 as described above the part of the plate 117 carrying the pin 122 is turned out and down from the recess 131 and after inserting the journal 123 into the position shown in FIG. 9 it is shifted up into the recess 131 until the journal 122 can be inserted into the recess or bore in the part 116 provided for this purpose. This bore is indicated in FIG. 9 by the reference number 133. The connection between the upper end of the back leg or the journal and the plate 117 can be detached by proceeding in the opposite manner.

In accordance with a further variation of the invention the journal 123 may be provided with an internal thread. This is particularly appropriate in the case of the embodiment example according to FIG. 5 in which the outer part 130 of the arm rest is missing. A screw shown with dotted lines is screwed into the journal 123 from the outer side of the upper end of the back leg 113. It prevents the journal 123 from slipping out of the bearing shell 125 as a result of the cap of the attaching screw because the head or cap of the screw has to be selected so as to be larger than the internal diameter of the bearing shell (FIG. 5*a*).

A detailed description of the connection between the upper ends of the back leg 113 and the front leg 110, on the other hand, and the side-beams 103, 104, on the other hand, is not necessary as these connections are known per se. It is worth mentioning, however, that conventional connection pieces or connection plates 105, 114, which correspond to the widths of the above-mentioned parts, are used for connecting these parts. The connection pieces or plates 105, 114 are inserted into central slots on the ends of the legs and anchored by means of appropriate pins or bearing shells.

In accordance with the invention it is possible to adjust the inclination of the back of the chair and/or seat 104.

Figure 8:
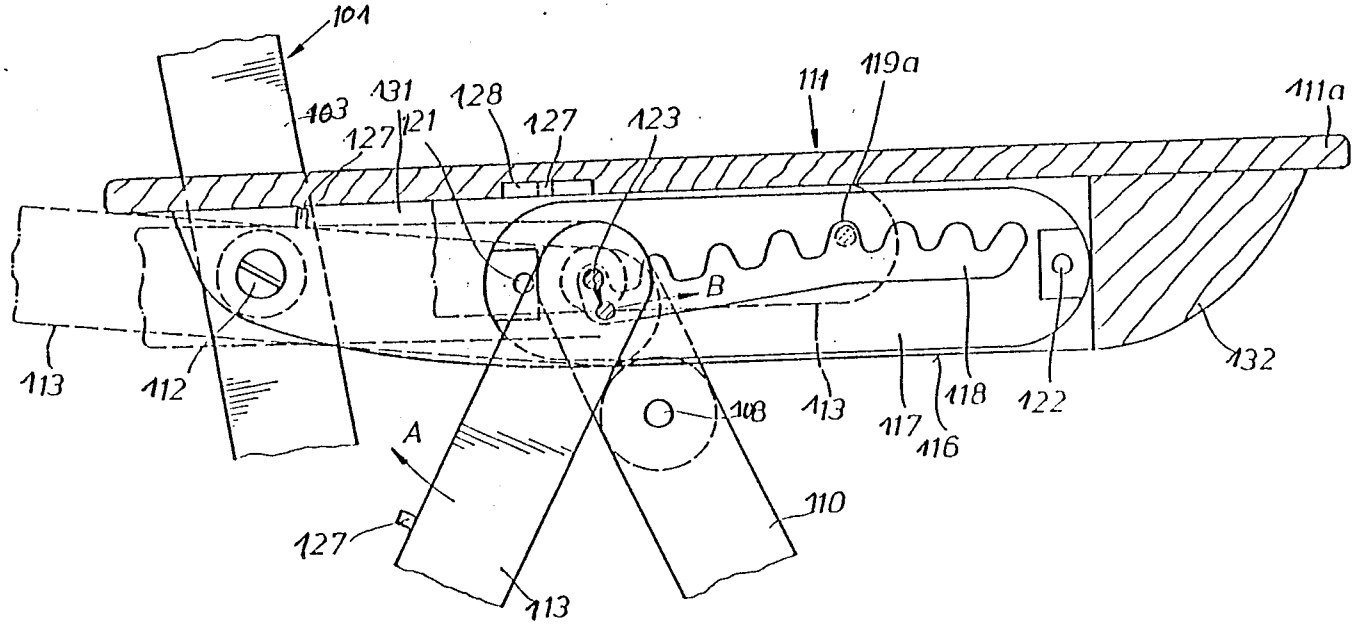
FIG. 8 is a sectional view of the arm of the chair in the embodiment as shown in FIG. 7.

It is apparent from the above description that the embodiments according to FIGS. 7 and 8 are substantially the same as the one shown in FIGS. 5 and 6 with the exception that the catch means is arranged inside the recess 131, whereas in the embodiments according to FIGS. 5 and 6 the catch means is facing the outside. In both embodiments a solid member 132 may be provided on the front side of the arm 111, whereas the side of the arm facing the back of the chair has no end portion, as is readily apparent from FIG. 6.

The embodiments of the folding chair described are made preferably of wood except for the plate 117, the journal 123 and the connection pieces. If the folding chair or parts thereof are made of plastic the arm rest shown in FIGS. 7 and 8 can be varied such that cheeks protruding laterally downwards from the supporting surface 111 form parts 116, 130 defining therebetween the recess 131 necessary for holding the plate 117 and the legs 108, 110 in accordance with FIG. 7.

When applying the adjustment of the seat inclination described with reference to FIGS. 1 to 4 in conjunction with the adjustable chair described with reference to FIGS. 5 to 9, a reclining chair can be converted such that the seat lies practically horizontally so that the chair with upwardly adjusted back is suitable for use as a dining chair.

The above description went into detail in particular on the adjustment means provided on the right side of the folding chair. It will be readily apparent that an identical, symmetrically constructed adjustment mechanism is provided on the left side of the folding chair so as to be able to adjust the back and/or seat 102 of the chair as described.

In a preferred embodiment of the adjustment means the stopper element 127 is provided at a distance from the journal 123. This distance corresponds approximately to the length of the guide slot 118 of the plate 117. According to a further embodiment of the invention guide means 115 are provided on each back leg 113 for holding a guide member 107 which is arranged between the back and the seat of the chair. It is advantageous to provide the guide means as a guide groove 115 formed on the inward side of each back leg 113. According to a still further embodiment of the invention the guide groove 6 is provided with at least two catch grooves 15, 16 on its upper end. The catch grooves 15, 16 may be provided at an obtuse angle to the guide groove. Furthermore, the guide groove 6 may be inclined towards the axis of the respective back leg 4.

What is claimed is:

1. An adjustment mechanism for folding furniture including a back, a seat, at least one front leg, at least one rear leg, and an arm rest, the adjustment mechanism being adapted to be positioned at the arm rest for adjusting the relative position of the back and seat and for allowing the back, seat, front and rear legs and the arm rest to be folded flat against each other to assume a compact storage position, the front and rear legs having a connection means positioned therebetween for allowing the front and rear legs to be folded together, the adjustment mechanism comprising:

a support surface forming part of the arm rest, at least one projecting part extending downwardly from the support surface to define a space beneath the support surface and adjacent the projecting part, the space being sized for receiving the front and rear legs;

a catch plate mounted on the projecting part within the space for adjusting the relative inclinations of the back, seat and arm rest;

an element for extending through one of the front and rear legs and the connection means and being adapted to be received in the catch plate for positioning the back and seat and;

repositioning means for automatically repositioning the element when the front and rear legs are folded together for allowing the back, sea, front and rear legs and the arm rest to assume its compact storage position, said repositioning means including a stopper element positioned on the rear leg.

2. An adjustment mechanism for folding furniture including a back, a seat, at least one front leg, at least one rear leg, and an arm rest, the adjustment mechanism being adapted to be positioned at the arm rest for adjusting the relative position of the back and seat and for allowing the back, seat, front and rear legs and the arm rest to be folded flat against each other to assume a compact storage position, the front and rear legs having a connection means positioned therebetween for allowing the front and rear legs to be folded together, the adjustment mechanism comprising:

a support surface forming part of the arm rest, at least one projecting part extending downwardly from the support surface to define a space beneath the support surface and adjacent the projecting part, the space being sized for receiving the front and rear legs, the support surface including a recess facing the space;

a catch plate mounted on the projecting part within the space for adjusting the relative inclinations of the back, seat and arm rest;

an element for extending through one of the front and rear legs and the connection means and being adapted to be received in the catch plate for positioning the back and seat and;

repositioning means for automatically repositioning the element when the front and rear legs are folded together for allowing the back, seat, front and rear legs and the arm rest to assume its compact storage position, said repositioning means including a stopper element positioned on the rear leg and received in said recess.

3. The adjustment mechanism as defined by claim 1, wherein the catch plate includes a guide slot and a plurality of catch recesses for receiving the element.

4. The adjustment mechanism as defined by claim 3, wherein the element snaps into one of the catch recesses.

5. The adjustment mechanism as defined by claim 1, wherein the element is a journal element.

6. The adjustment mechanism as defined by claim 5 wherein the journal extends through an upper end of the rear leg.

7. The adjustment mechanism as defined by claim 5 wherein the journal element includes an end facing the projecting part having a head which shifts together with the journal element between the catch plate and the projecting part.

8. The adjustment mechanism as defined by claim 1, wherein the means for repositioning the element includes a guide slot and a plurality of catch recesses positioned on the catch plate.

9. The adjustment mechanism as defined by claim 8, wherein the guide slot is curved.

10. The adjustment mechanism as defined by claim 1, wherein the connection means allows relative pivotal movement between the front and rear legs.

11. The adjustment mechanism as defined by claim 1 wherein the projecting part includes a recess formed therein and facing the space and wherein the catch plate includes two mounting elements projecting from the plate received in the recesses.

12. The adjustment mechanism as defined by claim 1 wherein the one of the front and rear legs through which the element extends includes a bearing shell into which the element is mounted.

13. The adjustment mechanism as defined by claim 1 including two projecting parts extending downwardly from the support surface spaced a distance apart for receiving the width of the front and rear legs.

14. The adjustment mechanism as defined by claim 13 wherein the element has a length approximately the same as the width of the space.

15. The adjustment mechanism as defined by claim 13 wherein the two projecting parts are formed integral with the arm rest.

16. The adjustment mechanism as defined by claim 1 wherein the rear leg has an upper end through which the element extends and is arranged such that the element simultaneously secures the connection plate to the rear leg.

* * * * *